US006116957A

United States Patent [19]

Mickievicz et al.

[11] Patent Number: 6,116,957

[45] Date of Patent: Sep. 12, 2000

[54] ELECTRICAL CONNECTOR FOR INTERCONNECTING TWO CIRCUIT BOARDS

[75] Inventors: Scott Keith Mickievicz, Elizabethtown; Scott Anthony Faulkner; Edmund Luther Jacobs, both of Harrisburg, all of Pa.

[73] Assignee: The Whitaker Corporation, Wilmington, Del.

[21] Appl. No.: 08/992,047

[22] Filed: Dec. 17, 1997

[51] Int. Cl.[7] ..... H01R 23/70

[52] U.S. Cl. ..... 439/631; 439/632

[58] Field of Search ..... 439/61, 631, 74, 439/632, 513

[56] References Cited

U.S. PATENT DOCUMENTS

| | | | |
|---|---|---|---|
| 3,215,968 | 11/1965 | Herrmann | 439/631 |
| 3,778,753 | 12/1973 | Occhipinti et al. | 339/156 R |
| 3,858,961 | 1/1975 | Goodman et al. | 439/631 |
| 3,960,424 | 6/1976 | Weisenburger | 339/17 M |
| 4,245,876 | 1/1981 | Ritchie et al. | 339/59 M |
| 4,521,065 | 6/1985 | Nestor et al. | 339/75 MP |
| 4,634,199 | 1/1987 | Anhalt et al. | 339/17 M |
| 4,747,790 | 5/1988 | Masuda et al. | 439/631 |
| 4,806,103 | 2/1989 | Kniese et al. . | |
| 5,015,197 | 5/1991 | Redmond et al. | 439/631 |
| 5,484,295 | 1/1996 | Mowry et al. | 439/66 |

*Primary Examiner*—Steven L. Stephan
*Assistant Examiner*—Hae Moon Hyeon

[57] ABSTRACT

An electrical connector (10) for interconnecting discrete circuits on a first circuit board (14) with discrete circuits on a second circuit board (16), includes an insulating housing (18) having a series of contact members (20) arranged in side by side cavities (22). Each contact member (20) has a straight shank (130) that is only partially supported by the floor (32) of the housing. The shank (130) has a first beam (136) at one end and a second beam (138) at the other end, each end of which has a respective one of first and second contacts (140, 142) attached thereto. Each contact terminates in a pre-load member (144, 146) that is formed parallel to the shank and slidingly extends into a recess (120) in the housing. Each pre-load member (144, 146) includes a latch surface (168) that abuts against a stop surface (124) formed in the housing (18) to limit movement of the contacts and thereby provide a desired pre-load to each contact (140, 142). The first and second beams (136, 138) are structured to partially extend into cutouts (90) in the floor (32) of the housing to minimize overall height of the connector. Additionally, the unsupported portions of the shank (130) of each contact member (20) resiliently deflect into their respective cutouts (90) thereby enhancing the affects of the first and second beams (136, 138).

16 Claims, 7 Drawing Sheets

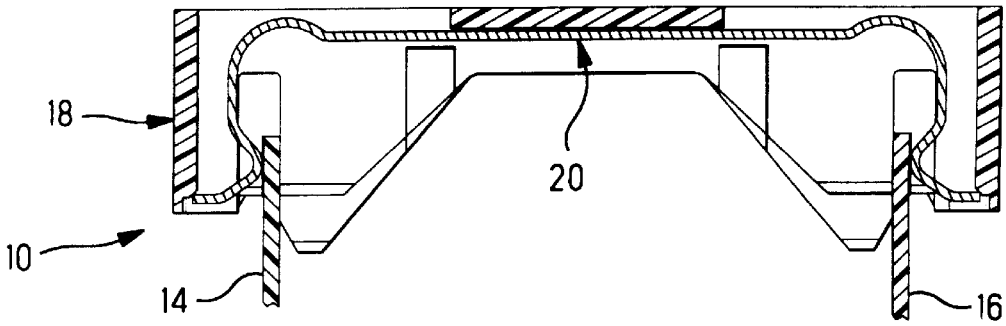
FIG. 4
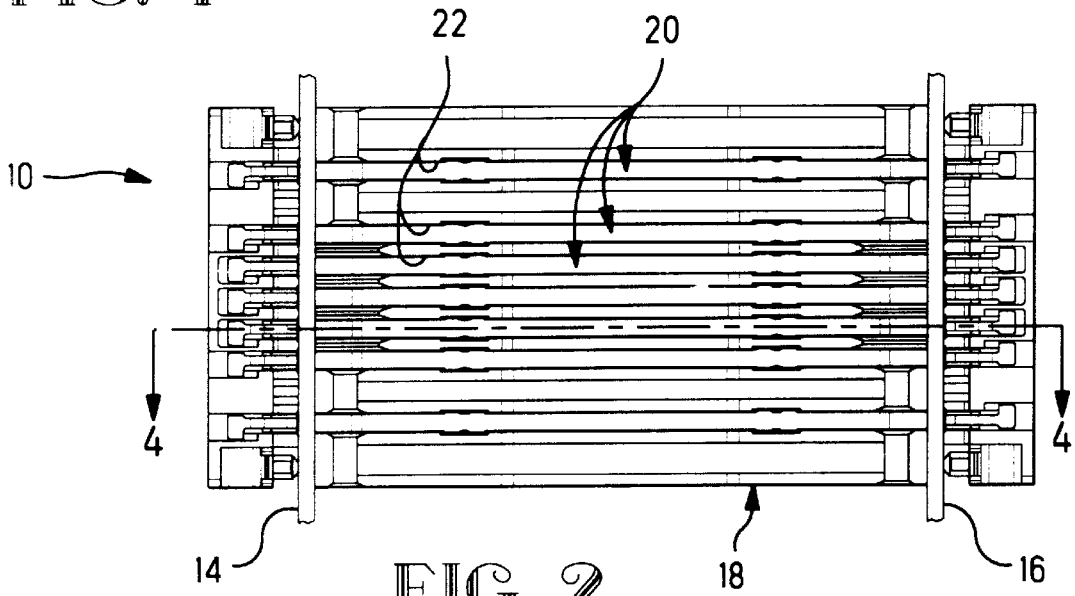
FIG. 2
FIG. 3
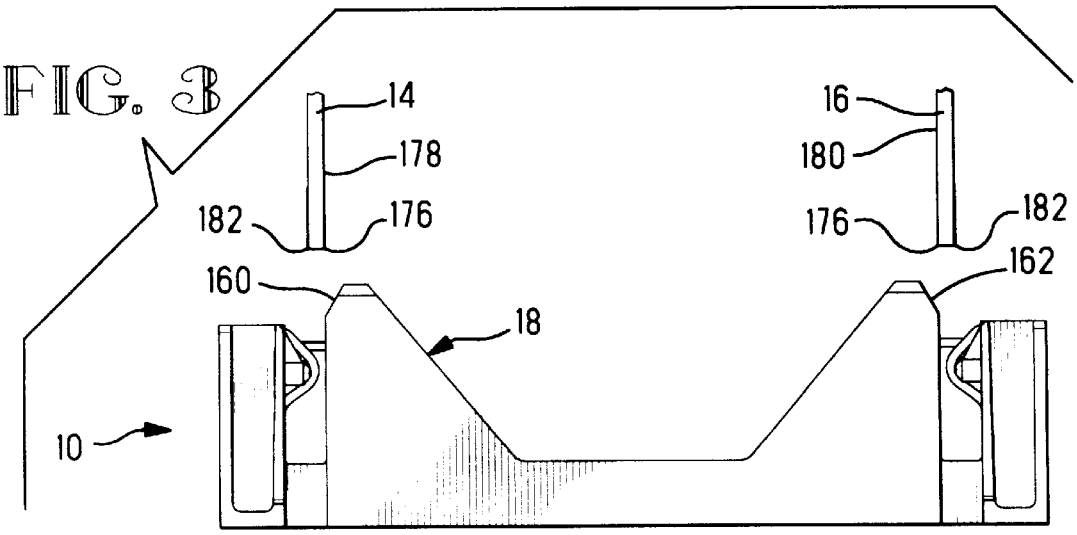

ELECTRICAL CONNECTOR FOR INTERCONNECTING TWO CIRCUIT BOARDS

The present invention relates to connectors for interconnecting the circuitry of parallel circuit boards, and more particularly to such connectors having a reduced height.

BACKGROUND OF THE INVENTION

Electrical connectors of the type that interconnect circuitry between two circuit boards typically interconnect so called daughter boards to mother boards, or one circuit board to another parallel circuit board where the two boards are vertically stacked, one over the other. In the case of the daughter board it is usually positioned perpendicular to the mother board and includes contact pads along its edge that interconnect to its circuitry. This edge of the daughter board is received in a connector that is mounted to the motherboard. Electrical contacts are spaced within the connector housing to engage the contact pads along one or both sides of the board. These contacts include tail portions that are either received in plated through holes in the mother board or are surface mounted thereto to complete the connection to the circuitry on the mother board. Where the circuit elements of two parallel circuit boards are to be interconnected, an edge connector is employed having two spaced apart channels, each of which receives the edge of a respective circuit board. The connector, called a jumper connector, includes contact members having a spring contact element at each end, one contact element in engagement with the circuitry of one board and the other contact element in engagement with the circuitry of the other board. In both of these cases the contacts are usually pre-loaded so that adequate contact force can be achieved when the circuit boards are mated to the connector. This pre-loading requires that each contact element have an extended portion that engages and rides in a slot, usually disposed parallel to the plane of the circuit board. See, for example, U.S. Pat. No. 3,778,753 which issued Dec. 11, 1973 to Occhipinti et al. The connector of the '753 patent includes a pair of U-shaped contact members which form two rows of pairs of contact elements that engage the pads on the two parallel circuit boards. Each contact member includes a flat shank portion that is secured to the bottom floor of the connector housing and includes two relatively straight and rather long beams extending upwardly that terminate in contact element that engage the circuitry of the circuit boards. Each contact element includes a T-shaped end that is captured in a vertical track formed in the housing. As the contact member is initially inserted into the connector housing each contact element is deflected slightly away from the channel that it is being inserted into so that the T-shaped end engages the vertical track. This structure results in a substantial vertical movement of the T-shaped ends in their respective tracks when mated with the circuit boards, thereby resulting in the connector being relatively higher than would otherwise be necessary. In applications where space is at a premium, such as high density electronic packages in the portable computer and telecommunications industries, such bulky jumper connectors are unusable.

What is needed is an electrical connector for interconnecting the circuitry on two parallel circuit boards having a structure that lends itself to miniaturization and that minimizes the overall height of the connector and its encroachment onto the circuit board.

SUMMARY OF THE INVENTION

An electrical connector is provided for interconnecting discrete circuits on a first circuit board with discrete circuits on a second circuit board. The connector includes an insulating housing having a lateral axis and a plurality of spaced parallel side by side cavities formed therein. First and second spaced openings are formed in the housing for receiving an edge of each of the first and second circuit boards. A plurality of electrical contact members are arranged so that each contact member is in a respective one of the plurality of spaced cavities. Each contact member includes a shank disposed perpendicular to the lateral axis in a respective one of the plurality of cavities. A first beam extends from a first end of the shank and a first contact is attached to the first beam opposite the shank projecting into the first opening for electrical engagement with one of the discrete circuits on the first circuit board. The first beam terminates in a first pre-load member outside of the first opening. A second beam extends from a second end of the shank opposite the first end and a second contact is attached to the second beam opposite the shank projecting into the second opening for electrical engagement with one of the discrete circuits on the second circuit board. The second beam terminates in a second pre-load member outside of the second opening. The first and second pre-load members extend outwardly away from the lateral axis and parallel to the shank for positioning the first and second contacts apart so that the first and second beams are elastically deflected mutually outwardly, thereby pre-loading the first and second contacts.

DESCRIPTION OF THE FIGURES

FIGS. 2 and 3 are plan and side views, respective, of the connector shown in FIG. 1;

FIG. 4 is a cross-sectional view taken along the lines 4—4 in FIG. 2;

DESCRIPTION OF THE PREFERRED EMBODIMENT

Figure 1:
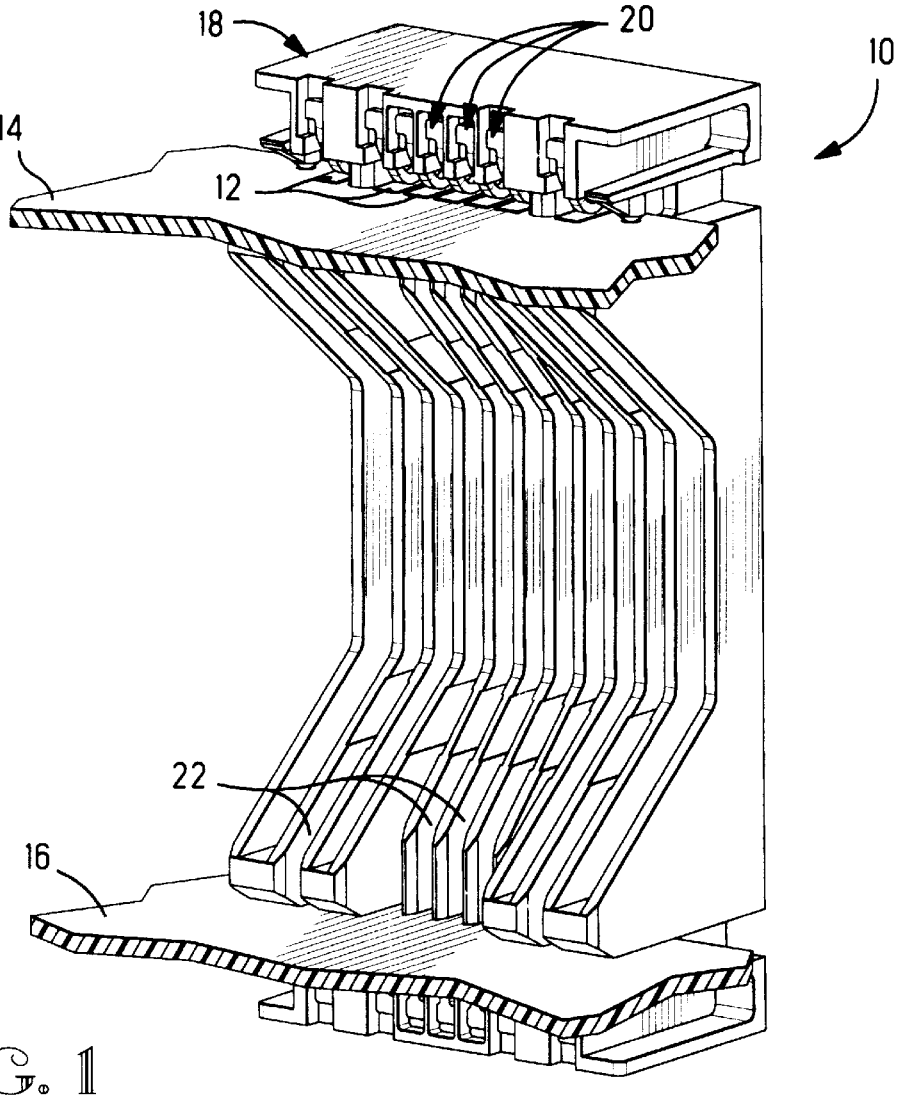
FIG. 1 is an isometric view of a connector incorporating the teachings of the present invention.

There is shown in FIGS. 1, 2, and 3, a jumper connector 10 for electrically interconnecting to contact pads 12 on two mutually parallel vertically aligned circuit boards 14 and 16. The jumper connector 10 includes an insulated housing 18 and a group of side by side contact members 20 arranged in individual cavities 22 formed in the housing. While there are seven contact members in the present example, it will be understood that the teachings of the present invention may be practiced with any number of contacts.

Figure 7A:
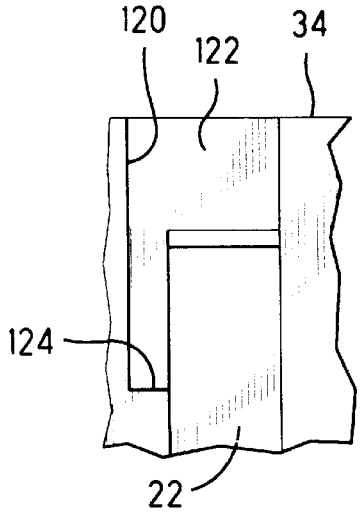
FIGS. 5, 6, 7, and 8 are back, side, plan, and end views, respectively, of the connector housing shown in FIG. 1.
Figure 5:
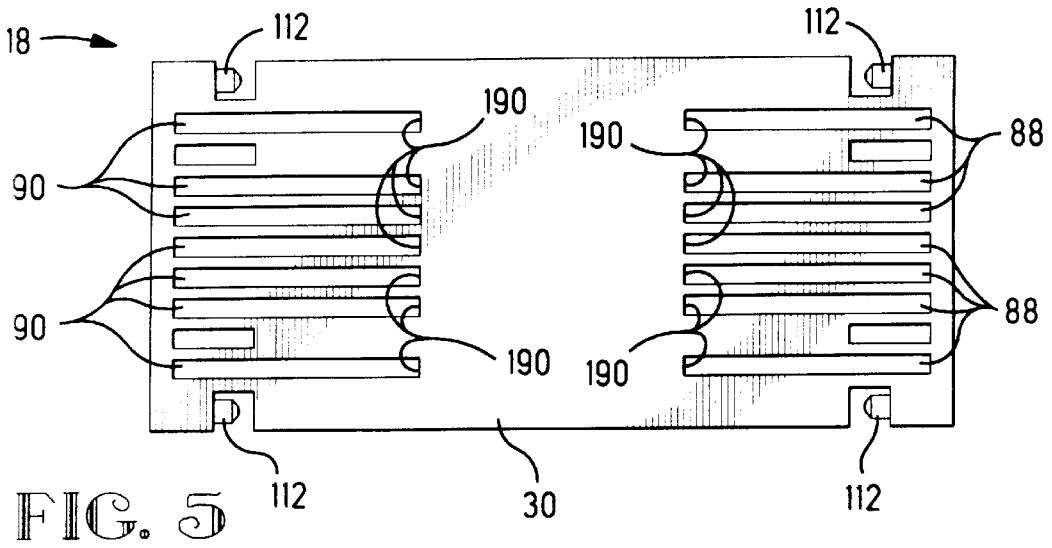
Figure 6:
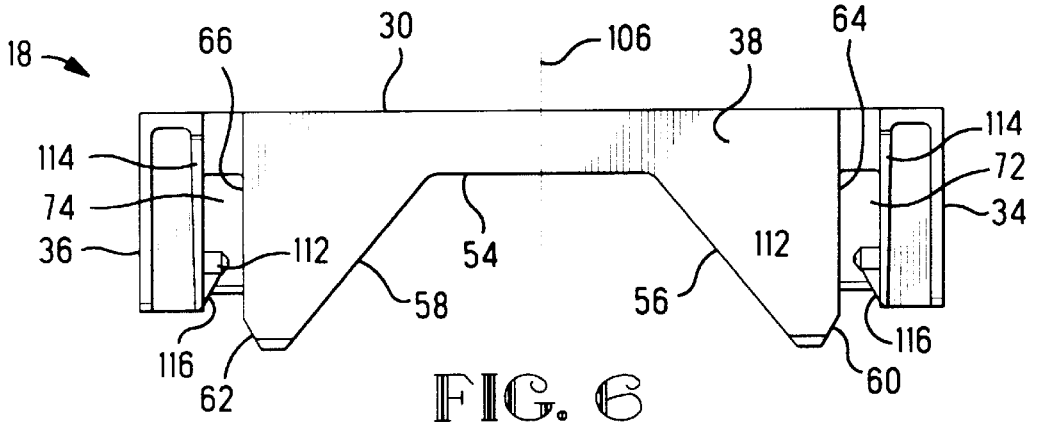
Figure 7:
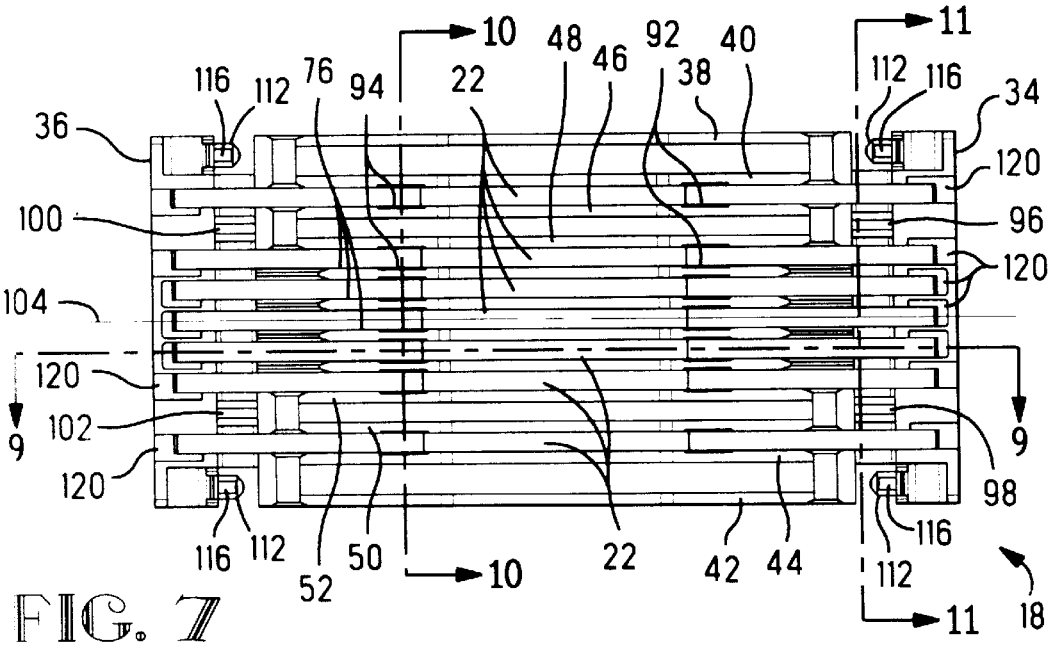
Figure 8:
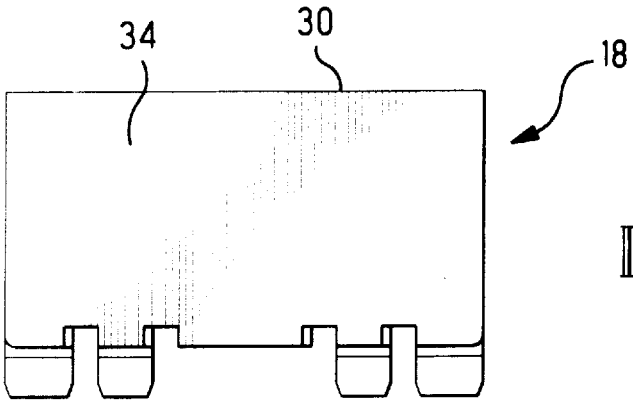
Figure 9:
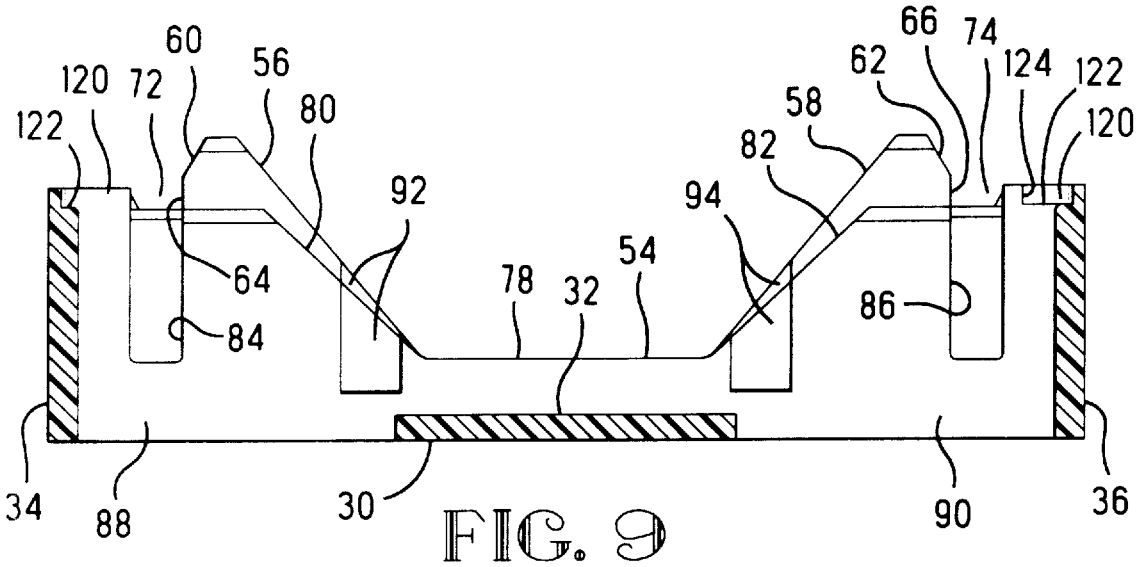
FIGS. 9, 10, and 11 are cross-sectional views taken along the lines 9—9, 10—10, and 11—11, respectively, in FIG. 7.
Figure 10:
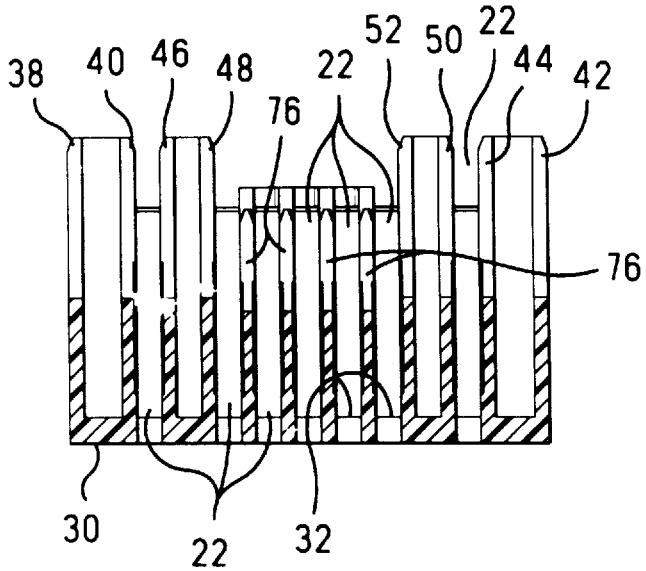
Figure 11:
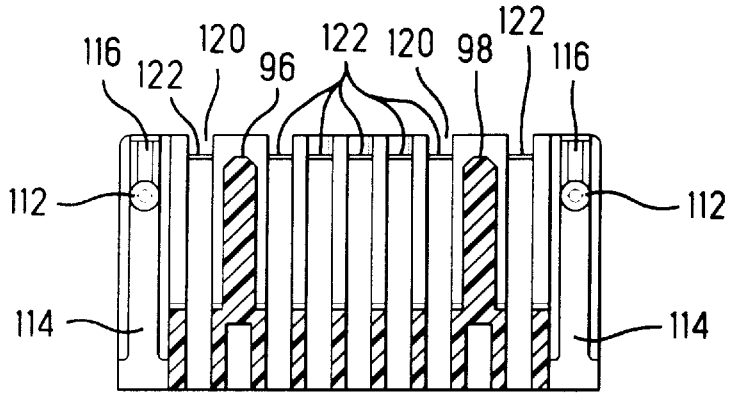
Figure 12:
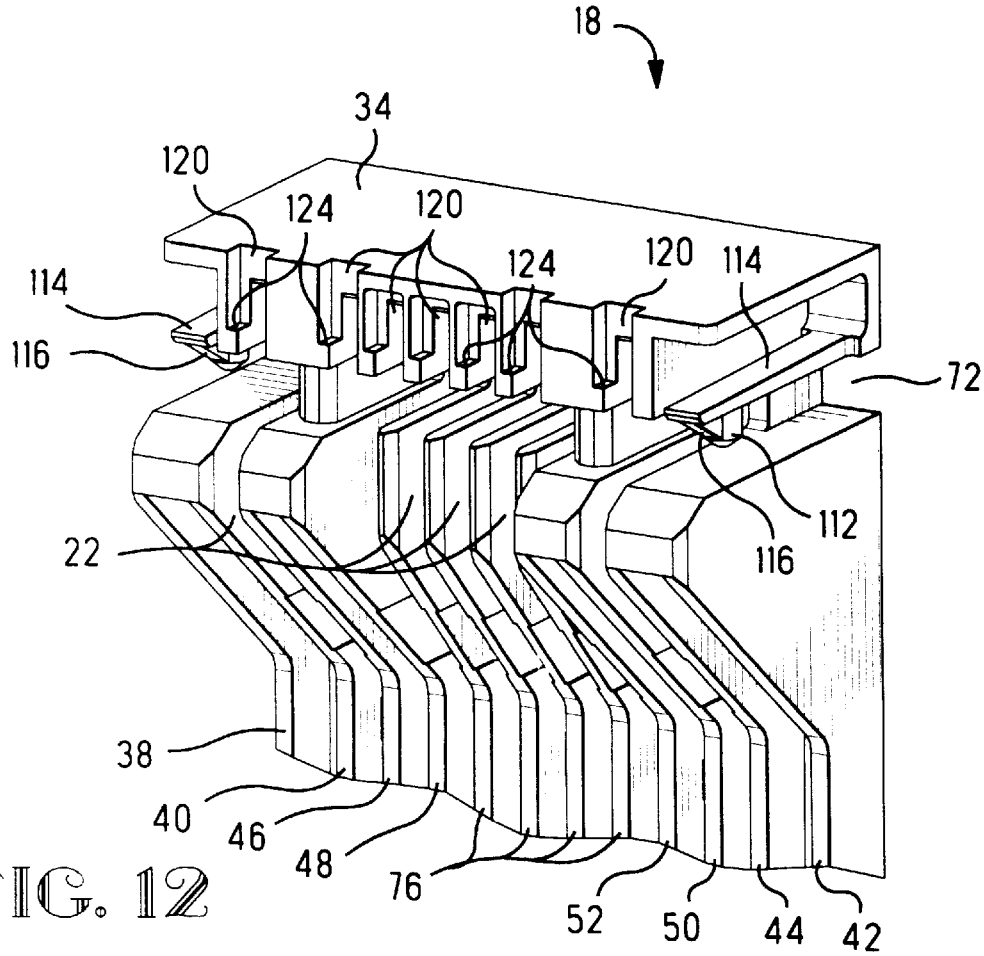
FIG. 12 is an isometric view of a portion of the connector housing shown in FIG. 7.

The housing 18, as best seen in FIGS. 5 through 12, includes a base 30 having an upwardly facing floor 32, as viewed in FIG. 9, a pair of end walls 34 and 36 and two pairs of longitudinal side walls 38, 40, 42, and 44 disposed on opposite sides of the housing, as best seen in FIG. 7. Another two pairs of longitudinal walls 46, 48, 50, and 52 are disposed adjacent to and between the side walls 38 and 42. All of the longitudinal walls 38 through 52 have the profile shown in FIG. 6, including a lower edge 54, outwardly angled edges 56 and 58, and inwardly angled edges 60 and 62 which terminate In surfaces 64 and 66 which extend to and are perpendicular with the base 30. The surfaces 64 and 66 form upper and lower openings 72 and 74, respectively, with the end walls 34 and 36 for receiving the circuit boards 14 and 16 while the angled edges 60 and 62 form lead in surfaces to guide the circuit boards into the openings. Four spaced apart longitudinal walls 76, as best seen in FIGS. 7 and 10, are disposed between the walls 48 and 52. The four longitudinal walls 76 have the profile shown in FIG. 9, including a lower edges 78 that is in alignment with the edge 54, outwardly angled edges 80 and 82, and surfaces 84 and 86 which are in alignment with the surfaces 64 and 66, respectively, and help to form the upper and lower openings 72 and 74. The four longitudinal walls 76 and the longitudinal walls 40, 46, 48, and 44, 50, 52 form the seven cavities 22 which receive the contact members 20. Each of the cavities 22 includes a cutout 88 and a cutout 90 through the base 30 and adjacent the end walls 34 and 36, as best seen in FIGS. 5 and 9. Each of the longitudinal walls 46, 48, 50, 52, and 76 includes upper and lower recesses 92 and 94, respectively, formed on opposite sides of each wall while the longitudinal walls 40 and 44 have similar recesses 92 and 94 on only one side facing inwardly. All of the recesses 92 are in alignment and the recesses 94 are in alignment, for a purpose that will be explained. The housing 18 includes two keys 96 and 98 that extend from the end 34 to the longitudinal walls 46, 48, and 50, 52, respectively, and two keys 100 and 102 that extend from the end 36 to the other ends of the same longitudinal walls. The keys are sized to be received in keyways formed in the edges of the circuit boards 14 and 16. The four keys 96 through 102 are arranged symmetrically about a longitudinal axis 104, shown in FIG. 7, and a lateral axis 106, shown in FIG. 6, so that the connector 10 can be assembled to the circuit boards without regard to orientation. There are four latches 112, each extending from a resilient beam 114 into a respective one of the upper and lower openings 72 and 74. The resilient beams 114, as best seen in FIG. 6 and 11, are cantilevered from respective ends 34 and 36 adjacent the base 30. Each latch 112 includes a ramp surface 116 that cams against the forward edges of the circuit boards 14 and 16 as the circuit boards are being inserted into the upper and lower openings 72 and 74. This deflects the latches outwardly while they track along the surfaces of the circuit boards until they engage and move into holes that are in the two circuit boards for locking the connector in place. Each of the cavities 22 terminates at each end thereof in a recess 120 having a floor surface 122 that is parallel with the floor 32. Additionally, each recess 120 includes a vertically disposed stop shoulder 124, as best seen in FIGS. 7A and 9, for a purpose that will be explained.

Figure 14:
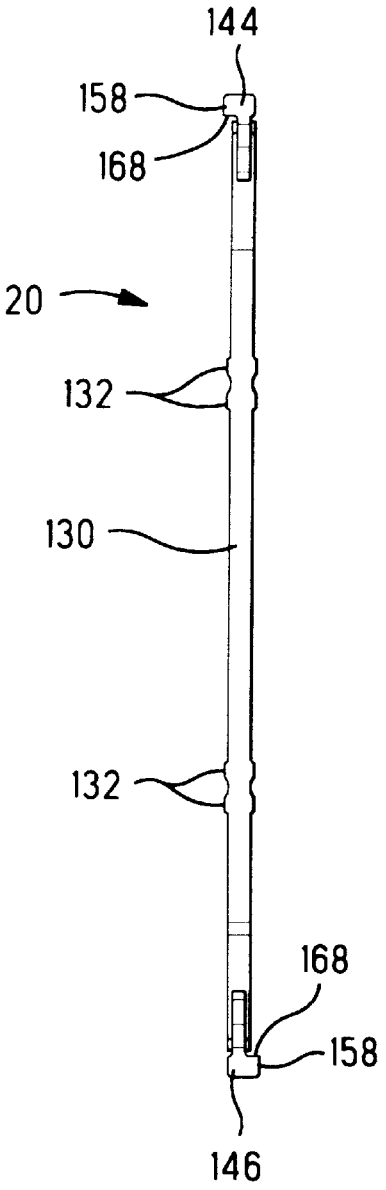
FIGS. 13, 14, and 15 are side, plan, and end views, respectively, of one of the contact members shown in FIG. 2.
Figure 13:
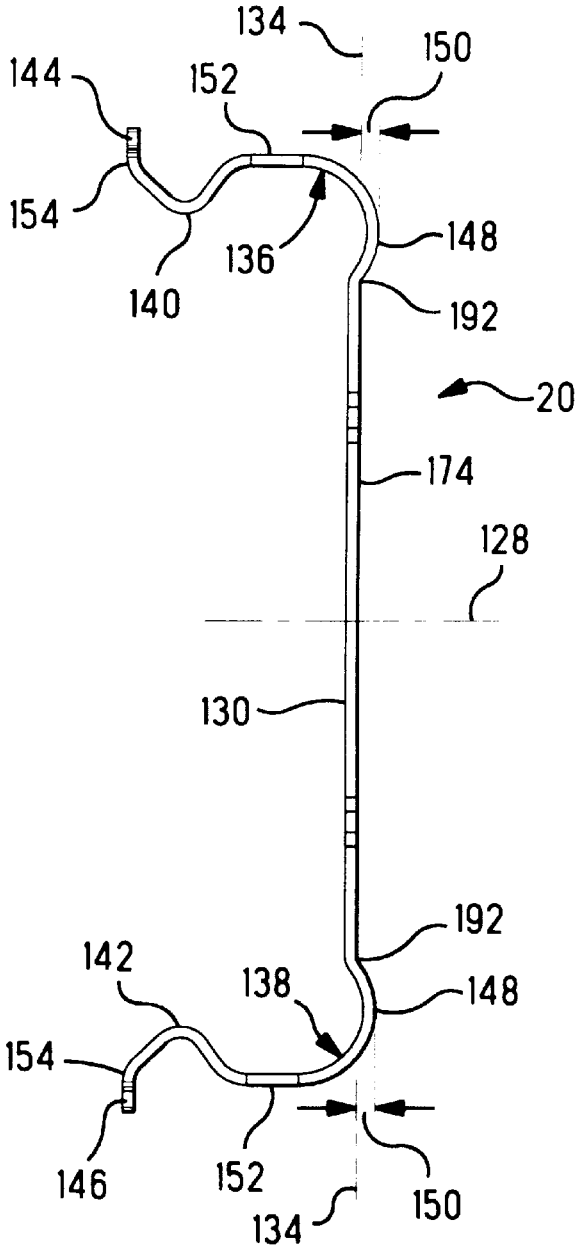
Figure 15:
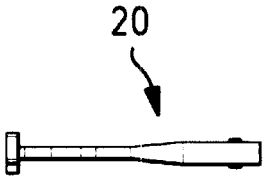
Figure 16:
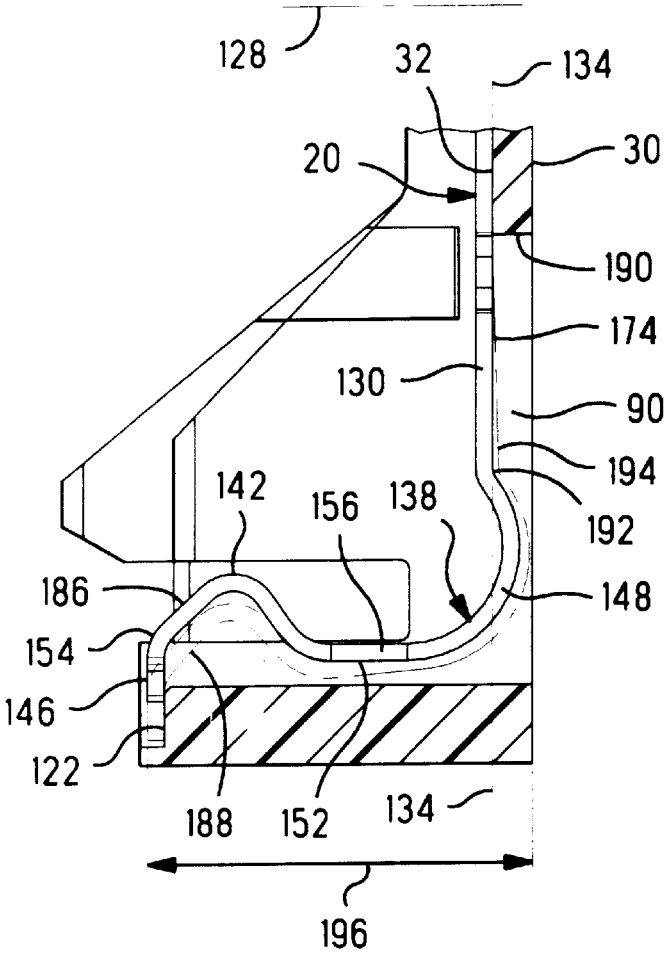
FIG. 16 is an enlarged view of a portion of the contact member shown in FIG. 13.
Figure 17:
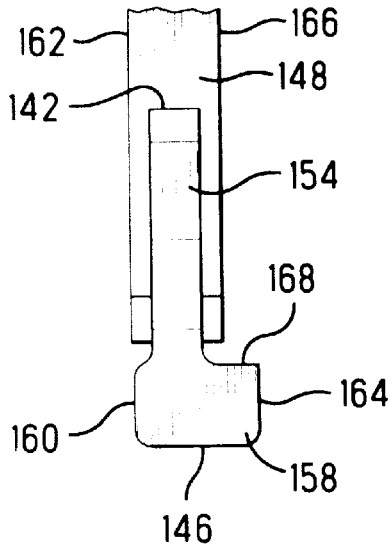
FIG. 17 is a plan view of the portion of the contact member shown in FIG. 16.
Figure 18:
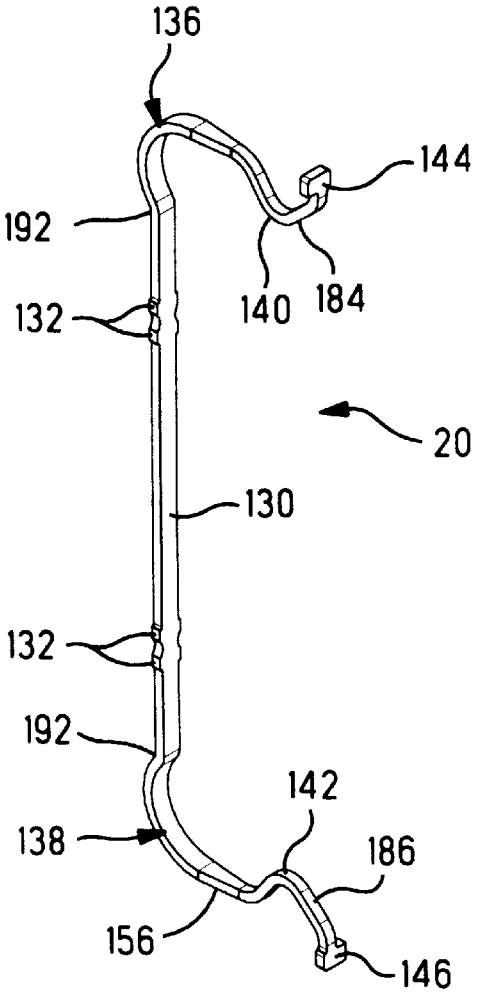
FIG. 18 is an isometric view of the contact member shown in FIG. 13.

All of the contact members 20 are substantially identical and take the form shown in FIGS. 13 through 18. Each contact member 20 includes a shank 130 having a lateral centerline or axis 128, about which the contact member is symmetrical, as viewed in FIG. 13. The contact member is stamped and formed from a strip of material in the usual manner, and includes four slightly enlarged portions 132, where the contact was severed from its carrier strip, that extend outwardly from each side of the shank 130, as shown in FIG. 14. The enlarged portions 132 are used to retain the contact member in the cavity 22 as will be explained. The bottom surface of the shank, which rests upon the floor 32 of the base 30, forms a plane 134, as best seen in FIG. 13. The two ends of the shank terminate in first and second beams 136 and 138, respectively, that extend outwardly therefrom and form first and second contact surfaces 140 and 142 and terminate at first and second pre-load members 144 and 146. Each first and second beam includes a first section 148, a portion of which is radiused, extending generally away from and laterally with respect to the shank 130 so that it extends to one side of the plane 134 an amount 150 that slightly exceeds the thickness of the shank. A second section 152, a portion of which is radiused, extends from the first section 148 generally to the opposite side of the plane 134 toward the lateral axis 128 to its respective contact 140, 142. A third section 154 extends from the contact 140, 142 in a direction away from the shank 130 and the axis 128, through a radiused portion and terminating at a respective one of the first and second pre-load members 144 and 146. The first and second pre-load members 144 and 146 are disposed parallel to the shank 130 and extend away from the lateral axis 128, as best seen in FIG. 13. As can be seen in FIGS. 16, 17, and 18, the width of the contact member 20 is narrowed down starting at 156 in the second section 152, through the contacts 140, 142, and up to the pre-load members 144 and 146. This narrowing of the thickness provides a desired contact width to correspond to the width of the contact pads 12 on the circuit boards 14 and 16. Each pre-load member 144 and 146, as best seen in FIGS. 14 and 17, includes an enlarged end 158 having one edge 160 that is in alignment with the side 162 of the first section 138 and another edge 164 that extends beyond the other side 166 of the first section. The width of the enlarged end 158 is chosen so that it is loosely received within the recess or cutout 120 and can slide slightly in the direction of the longitudinal axis 104, of housing 18 shown in FIG. 7, while remaining against the floor surface 122. The side 164 forms a latch surface 168 that abuts against the stop surface 124, shown in FIG. 7A, to limit movement of the enlarged head 158 in the direction toward the lateral axis 128 of contact member 20.

When a contact member 20 is prepared to be inserted into its respective cavity 22, the enlarged portions 132 are aligned with the upper and lower recesses 92 and 94 of the cavity and the beams 136 and 138 are slightly deflected so that the contact surfaces 140 and 142 are moved away from the axis 128 a sufficient amount. The contact member is then inserted into the cavity until the bottom surface 174 of the shank 130 is against the floor surface 32 of the base 30. As this is done, the enlarged portions 132 pass freely through the recesses 92 and 94 until reaching the bottoms of the recess where the enlarged portions dig in and deform the sides of the longitudinal walls to provide staked areas that serves to retain the contact member within its respective cavity. At this point the force that is deflecting the beams 136 and 138 is removed so that the resiliency of the beams tends to return the contact member to its free form shape. However, the latch surfaces 168 abut against the stop surfaces 124 preventing the contact member from returning completely to its free form. This imposes a pre-load on each of the beams 136 and 138 so that, when the circuit boards 14 and 16 are mated with the connector 10, this pre-load provides a desired amount of contact force. The structure of the beams 136 and 138 and the placement of the stop surfaces 124 can be altered to effect a change in the amount of contact force, as desired.

In operation, as the jumper connector is brought into alignment with the circuit boards 14 and 16, as shown in FIG. 3, the inner corners 176 of the two circuit boards engage one of the angled surfaces 60 and 62 which centers the connector and aligns it with the circuit boards. As the connector 10 is further moved so that the circuit boards enter into their respective openings 72 and 74, the inner facing surfaces 178 and 180 of the first and second circuit boards 14 and 16 engage and slide along the surfaces 64 and 66 of the housing 18. As movement continues the outer corners 182 of the two circuit boards engage respective ones of the angled portions 184 and 186 of the third sections 154, so that the third sections are cammed outwardly away from the axis 128 to the position 188 shown in phantom lines in FIG. 16. During this movement to the position 188, the first and second pre-load members 144 and 146 slide along the surfaces 122 in their respective recesses 120 in a direction away from the stop surfaces 124. As is best seen in FIG. 16, the radiused portion of the first section 148 is moved further into the cutout 90 but not completely through it. Additionally, because the cutouts 88 and 90 extend to walls 190 that are spaced from the ends 192 of the shank 130, the portions of the shank that extend unsupported over the cutouts are free to deflect slightly into the cutouts, as shown in phantom lines at 194, thereby providing additional elasticity to the beams 136 and 138 so that they can be structured to provide a minimum overall height 196, as indicated in FIG. 16.

It will be appreciated by those skilled in the art that the overall height of the connector 10 is minimized by the following three structural features. The pre-load members 144 and 146 are arranged parallel to the shank 130 and retained against the surfaces 122 during mating of the connector to the circuit boards; (2) the radiused portion of the first section 148 extended into the cutout 90; and (3) the unsupported end portions of the shank 130 are used as resilient members that deflect into the cutouts 90.

An important advantage of the present invention is that an electrical connector is provided for interconnecting the circuitry on two parallel circuit boards having a structure that minimizes the overall height of the connector and its encroachment onto the circuit boards.

We claim:

1. An electrical connector for interconnecting discrete circuits on a first circuit board with discrete circuits on a second circuit board, including an insulating housing having a lateral axis and a plurality of spaced parallel side by side cavities formed therein and including first and second spaced openings for receiving an edge of each of said first and second circuit boards, and a plurality of electrical contact members arranged so that each contact member is in a respective one of said plurality of spaced cavities, wherein each contact member comprises:

(1) a shank disposed perpendicular to said lateral axis of said housing;

(2) first and second beams extending from first and second opposite ends, respectively, of said shank;

(3) a first contact attached to said first beam and terminating in a first pre-load member outside of said first opening, and a second contact attached to said second beam and terminating in a second pre-load member outside of said second opening;

wherein said first and second pre-load members extend outwardly away from said lateral axis and parallel to said shank for positioning said first and second contacts apart so that said first and second beams are elastically deflected mutually outwardly, thereby pre-loading said first and second beams, and wherein said first and second pre-load members are arranged to move in opposite directions parallel to said shank and perpendicular to the lateral axis of the housing during mating with said circuit boards.

2. The connector according to claim 1 wherein said first contact projects into said first opening for electrical engagement with one of said discrete circuits on said first circuit board and said second contact projects into said second opening for electrical engagement with one of said discrete circuits on said second circuit board.

3. The connector according to claim 1 wherein said first pre-load member is in latching engagement with a first housing feature on said housing and said second pre-load member is in latching engagement with a second housing feature on said housing.

4. The connector according to claim 3 wherein said first pre-load member has a first projection extending laterally therefrom and said first housing feature includes a first cutout for loosely receiving said first pre-load member and a first shoulder for engaging said first projection and arranged to prevent movement of said first projection in a direction toward said axis while permitting movement thereof in an opposite direction.

5. The connector according to claim 4 wherein said second pre-load member has a second projection extending laterally therefrom and said second housing feature includes a second cutout for loosely receiving said second pre-load member and a second shoulder for engaging said second projection and arranged to prevent movement of said second projection in a direction toward said axis while permitting movement thereof in an opposite direction.

6. The connector according to claim 5 wherein each of said first and second cutouts includes a pair of opposite walls that separate adjacent first pre-load members and separate adjacent second pre-load members, respectively.

7. The connector according to claim 6 wherein each of said first and second openings includes a lead-in for receiving its respective first and second circuit board.

8. The connector according to claim 1 wherein said first and second openings are arranged to receive said first and second circuit boards when said circuit boards are parallel to said axis.

9. The connector according to claim 1 wherein each of said plurality of cavities includes a floor having a center portion against which a portion of a said shank of a respective said contact is disposed, said floor further including a pair of recesses, one on each side of said center portion so that said shank extends over each said recess.

10. The connector according to claim 9 wherein each of said first and second beams comprises:

(1) a first section, a portion of which is arcuate, extending generally away from and laterally with respect to said shank and partially into one of said recesses;

(2) a second section, a portion of which is arcuate, extending generally in a direction toward said axis and terminating at one of said first and second contacts;

(3) a third section, a portion of which is arcuate, extending from one of said first and second contacts in a direction away from said axis and terminating at a respective one of said first and second pre-load members.

11. The connector according to claim 10 wherein said first pre-load member is in latching engagement with a first housing feature on said housing and said second pre-load member is in latching engagement with a second housing feature on said housing.

12. The connector according to claim 11 wherein said first and second pre-load members have respective first and second projections extending laterally therefrom and said first and second housing features include respective first and second cutouts for loosely receiving respective first and second pre-load members and respective first and second shoulders for engaging said respective first and second projection and arranged to prevent movement of said first and second projections in a direction toward said axis while permitting movement thereof in an opposite direction.

13. An electrical connector for interconnecting circuits on a first circuit board with circuits on a second circuit board, including an insulating housing having a lateral axis and a plurality of spaced parallel side by side cavities formed therein and including first and second spaced openings for receiving a portion of each of said first and second circuit boards, and a plurality of electrical contact members arranged so that each contact member is in a respective one of said plurality of spaced cavities, wherein each contact member comprises:

(1) a shank;

(2) first and second beams extending from first and second opposite ends of said shank, each of said first and second beams including a respective first section, a portion of which is arcuate, extending generally away from and laterally with respect to said shank;

(3) first and second contacts attached to respective ones of said first and second beams and projecting into respective ones of said first and second openings for electrical engagement with said discrete circuits on respective ones of said first and second circuit boards;

wherein each of said plurality of cavities includes a floor having a center portion against which a portion of a said shank of a respective said contact is disposed, said floor further including a pair of recesses, one on each side of said center portion so that said shank extends over each said recess and each of said first and second beams extends partially into a respective one of said pair of recesses.

14. The connector according to claim 13 wherein each of said first and second beams includes a respective second section, a portion of which is arcuate, extending from a respective said first section generally in a direction toward said lateral axis and terminating at a respective one of said first and second contacts.

15. The connector according to claim 14 wherein each said contact member includes a third section, a portion of which is arcuate, attached to and extending from a respective one of said first and second contacts in a direction away from said lateral axis.

16. The connector according to claim 15 wherein said first opening includes a first wall opposite said first contacts, and said second opening includes a second wall opposite said second contacts, so that when mated with said first and second circuit boards, a surface of said first circuit board is in engagement with said first wall and a surface of said second circuit board is in engagement with said second wall.

* * * * *